US011779792B2

(12) United States Patent
Bielawski

(10) Patent No.: US 11,779,792 B2
(45) Date of Patent: Oct. 10, 2023

(54) FOLDABLE AND MOVABLE FITNESS OR WEIGHT RACK

(71) Applicant: Patryk Bielawski, Mason, OH (US)

(72) Inventor: Patryk Bielawski, Mason, OH (US)

( * ) Notice: Subject to any disclaimer, the term of this patent is extended or adjusted under 35 U.S.C. 154(b) by 0 days.

(21) Appl. No.: 17/406,414

(22) Filed: Aug. 19, 2021

(65) Prior Publication Data

US 2022/0054880 A1 Feb. 24, 2022

Related U.S. Application Data

(60) Provisional application No. 63/067,428, filed on Aug. 19, 2020.

(51) Int. Cl.
*A63B 21/078* (2006.01)

(52) U.S. Cl.
CPC ..... *A63B 21/078* (2013.01); *A63B 2210/50* (2013.01)

(58) Field of Classification Search
CPC ..... A63B 21/0626; A63B 21/0783; A63B 21/078; A63B 23/0355; A63B 21/0628; A63B 2023/0411; A63B 2071/0625; A63B 2210/50; A63B 2225/682; A63B 71/0622; A63B 2225/09
See application file for complete search history.

(56) References Cited

U.S. PATENT DOCUMENTS

| | | | | |
|---|---|---|---|---|
| 5,755,823 | A * | 5/1998 | Cleary | A63B 21/078 482/104 |
| 7,488,277 | B1 * | 2/2009 | Knapp | A63B 21/0626 482/106 |
| 10,953,301 | B2 * | 3/2021 | Brasch | A63B 71/0036 |
| 2009/0105052 | A1 * | 4/2009 | Dalebout | A63B 21/06 482/133 |
| 2015/0297948 | A1 * | 10/2015 | Meister | A63B 21/0552 482/121 |
| 2017/0120099 | A1 * | 5/2017 | Biddix, Jr. | A63B 23/1218 |
| 2017/0189736 | A1 * | 7/2017 | Martin | E04H 12/22 |
| 2018/0056116 | A1 * | 3/2018 | Le Nguyen | A63B 23/12 |

FOREIGN PATENT DOCUMENTS

| | | | | |
|---|---|---|---|---|
| DE | 102014225318 | A1 * | 6/2015 | A63B 7/00 |

* cited by examiner

*Primary Examiner* — Andrew S Lo
*Assistant Examiner* — Andrew M Kobylarz
(74) *Attorney, Agent, or Firm* — Trevor T. Graves; Stites & Harbison, PLLC

(57) ABSTRACT

A fitness rack is provided for performing exercising, training and weight lifting activities. The rack includes a base having a foldable cross-member with a handle. The rack also includes a first pair of uprights connected to the base. The handle is configured to be raised to horizontally collapse the pair of uprights such that the squat rack is transferred from an extended position to a closed position.

19 Claims, 25 Drawing Sheets

FOLDABLE AND MOVABLE FITNESS OR WEIGHT RACK

This application claims the benefit of U.S. Provisional Patent Application Ser. No. 63/067,428, filed on Aug. 19, 2020, the disclosure of which is incorporated herein by reference.

TECHNICAL FIELD

This disclosure relates generally to a fitness apparatus for exercising, training and weight lifting activities and, more particularly, to a squat or power rack that is easily foldable from an operating position for use in performing squats and other exercises to a storage position when not in use and easily movable for workout or storage purposes.

BACKGROUND

A fitness or weight rack is one of the most common and important pieces of equipment in many commercial and home gyms. Typically, a fitness or weight rack may either be a squat rack (also known as a squat stand) or a power rack (also known as a power cage or a squat cage). As the name implies, a squat rack is typically designed for holding a barbell in order to perform squat exercises, which primarily benefit the quadriceps muscles but also help work out a wide variety of other major muscle groups. A power rack differs from the squat rack in that it typically consumes more floor space as it is built like a solid steel cage with four uprights, while the squat rack is primarily made up of two uprights. Although a power rack, like the squat rack, is often used to perform squats, it is typically more versatile than the squat rack and provides additional safety features.

Aside from helping an individual build size and extra strength in the quadriceps, performing squats also activates a lot of other body parts and muscles, such as calves, hamstrings, and glutes and can improve core strength. In addition to performing squats, some squat racks are capable of being used in conjunction with other attachments and pieces of equipment, such as a dip attachment for performing dips, a bench for bench pressing, as well as ropes, bands and other accessories for various bodyweight exercises and activities. In addition to preforming squats, a power rack is designed such that it may also be used to perform a number of bodyweight exercises, such as pull-ups, chin-ups, dips and knee raises.

Although commercial gyms are still quite popular, many people prefer to work out and exercise from home in order to: (1) save time and expense involved with traveling to and from the gym; (2) avoid long waits to use various workout machines at commercial gyms; and (3) save money from costly gym membership fees. Indeed, the number of individuals working out at home has increased during the COVID-19 pandemic because of gym closures, compliance with government "stay at home" orders and avoiding the risk of getting sick.

Individuals seeking to work out from home can buy a squat or power rack to use in their home or garage. However, despite these types of racks being popular and essential pieces of equipment for most home gyms, they take up a lot of space (especially power racks), which is often limited in home gyms or garages and needed for other things, like automobiles. Furthermore, due to the size and weight of squat and power racks, they are often difficult to move or not designed to move at all, especially power racks which are often permanently installed and wall-mounted squat racks.

To address the problems associated with conventional squat racks, some foldable squat racks have been developed. However, these foldable squat racks suffer from certain disadvantages. For example, some foldable squat racks are made out of materials other than steel to cut down on weight to make them easier to store, but this effects the structural integrity of the squat rack and limits the amount of weight that can be used. Furthermore, most foldable squat racks are wall-mounted and fold horizontally such that the columns swing up against the wall. While these types of foldable squat racks provide additional space once in the stored position, they are limited to being mounted to the wall. Consequently, they require a certain amount of open wall space that may not be available and they cannot be moved. Although certain wall-mounted foldable squat racks may fold vertically, they require higher ceilings and greater open wall space, which is not always available.

Accordingly, there is a need for a foldable squat or power rack that is sturdy enough to perform all types of exercises and support a sufficient amount of weight for all types of individuals. Furthermore, the foldable squat or power rack should not be required to be wall-mounted, so that it is completely free-standing and may be stored in any available space in an individual's home or garage. Finally, in order to allow an individual to use and store the foldable squat or power rack in multiple areas, i.e., outside the garage on a sunny day, the squat or power rack should be easily mobile.

SUMMARY

In accordance with one aspect of the disclosure, a fitness rack is provided. The rack includes a base having a foldable cross-member with a handle. The rack also includes a first pair of uprights connected to the base. The handle is configured to be raised to horizontally collapse the pair of uprights such that the squat rack is transferred from an extended position to a closed position.

In one possible embodiment, the base includes a first arm and a second arm. The first arm may be connected to a first end of the foldable cross-member and the second arm may be connected to a second, opposed end of the foldable cross-member. The first arm may be perpendicular to a first of the pair of uprights and the second arm may be perpendicular to a second of the pair of uprights. Each of the pair of uprights may connect to a respective one of the first and second arms via one or more gussets. The foldable cross-member may include a first bracket connected to the first arm and a second bracket connected to the second arm. The first bracket may be connected to the second bracket via the handle.

In another embodiment, the fitness rack includes one or more wheels for connecting to the base for moving the fitness rack in the closed position. In yet another embodiment, the fitness rack includes an expansion kit having a second pair of uprights and a pair of slotted cross-members for connecting the second pair of uprights to the first pair of uprights. In still yet another embodiment, the handle is a round tube.

In accordance with another aspect of the disclosure, a foldable weight rack adapted to collapse from an operating position into a storage position is provided. The foldable weight rack includes a foldable handle configured to rest substantially on a floor in the operating position. The foldable weight rack also includes a first arm and a second arm, each arm connected to an opposed end of the foldable handle. The foldable weight rack further includes a first pair of spaced upstanding posts connected to the first arm and a second pair of spaced upstanding posts connected to the second arm. In use, the foldable handle extends upward from the floor such that the first and the second pair of spaced upstanding posts collapse together into the storage position.

In one embodiment, each of the first and second pair of spaced upstanding posts have a plurality of equally spaced holes. One or more attachments attach to the first and second pair of spaced upstanding posts via connection to the plurality of equally spaced holes. In an additional embodiment, each of the first and second arms have at least one projection for receiving a portion of a respective end of the foldable handle. The at least one projection in each of the first and second arms allows the portion of the respective end of the foldable handle to move freely such that the foldable handle extends upward in a vertical direction from the floor, while the first and second pair of spaced upstanding posts move only in a horizontal direction.

In another embodiment, the foldable weight rack includes a safety system for further connecting the second pair of uprights to the first pair of uprights. In yet another embodiment, the foldable weight rack includes a pull-up bar removably connected to each of the second pair of uprights.

In accordance with yet another aspect of the disclosure, a method of folding a weight rack including at least one pair of upright posts connected to a base having a handle portion is provided. The method includes removing one or more pins from the base. The method further includes raising the handle portion vertically such that the at least one pair of upright posts collapse horizontally toward each other. The method also includes securing the at least one pair of upright posts together in a collapsed position.

BRIEF DESCRIPTION OF THE DRAWINGS

The accompanying drawings incorporated in and forming a part of the specification, illustrate several aspects of this disclosure, and together with the description serve to explain the principles of the disclosure. In the drawings.

DETAILED DESCRIPTION

Figure 1:
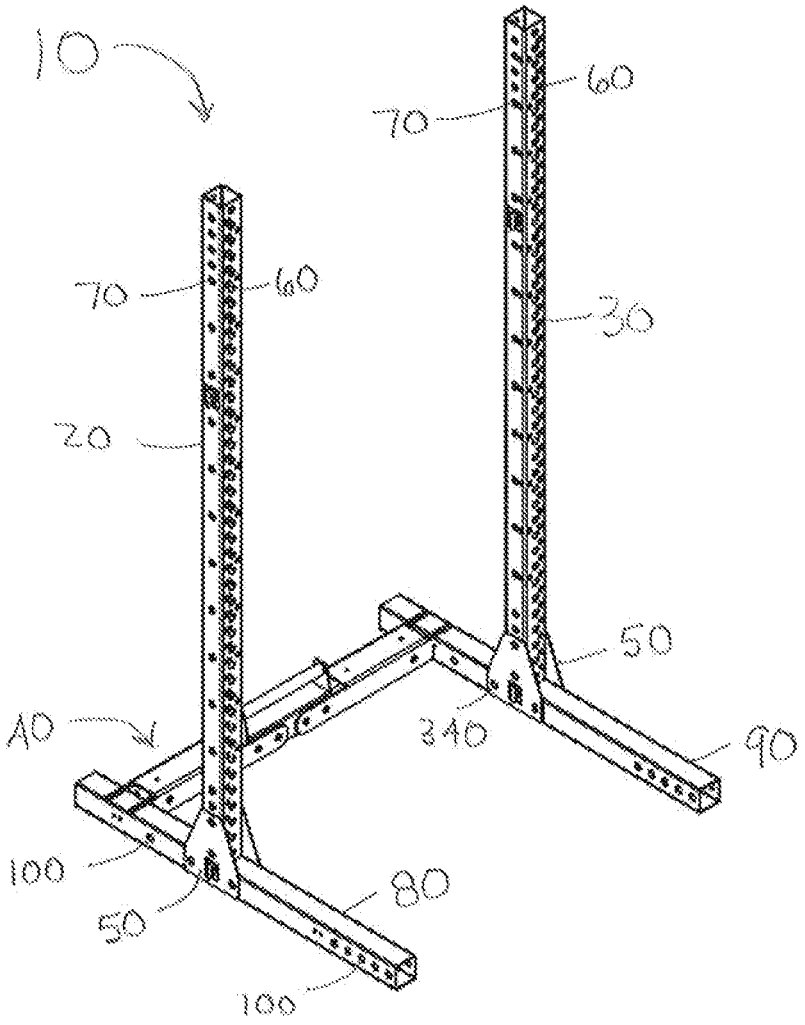
FIG. 1 is a front perspective view of a foldable and movable squat rack in an open configuration forming one aspect of this disclosure.
Figure 2:
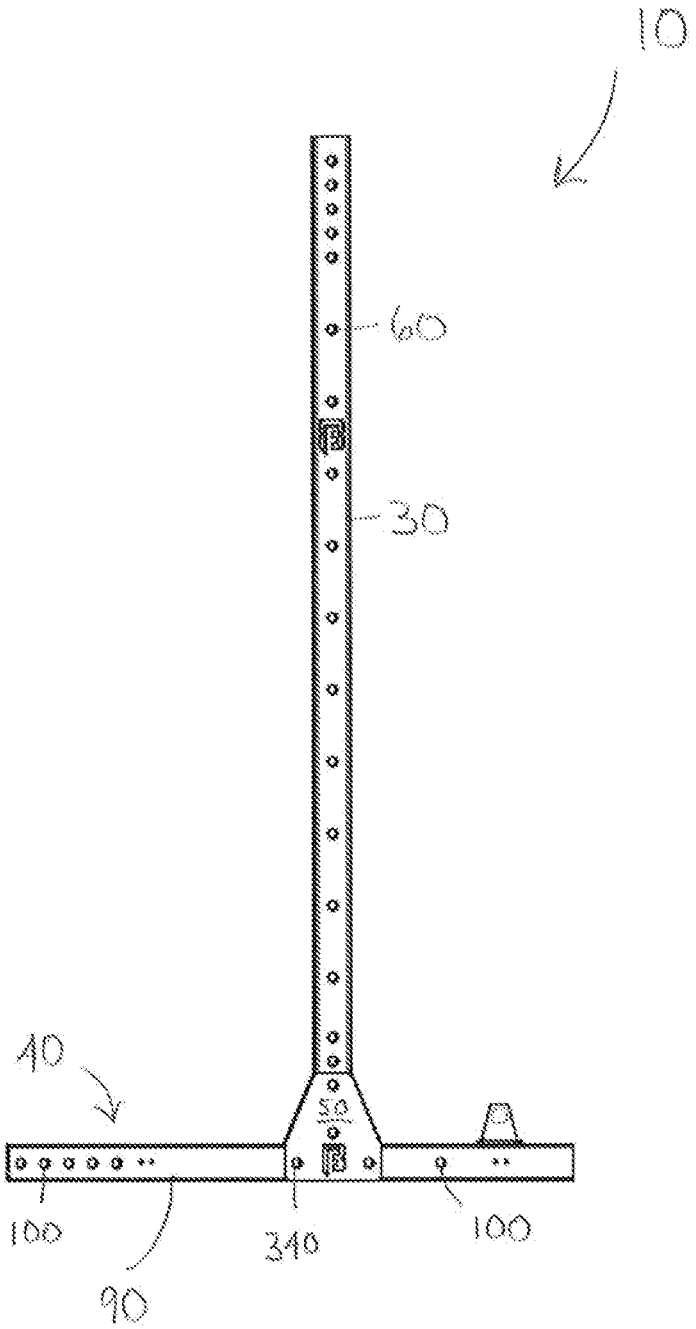
FIG. 2 is a side view of the foldable and movable squat rack in the open configuration forming one aspect of this disclosure.
Figure 3:
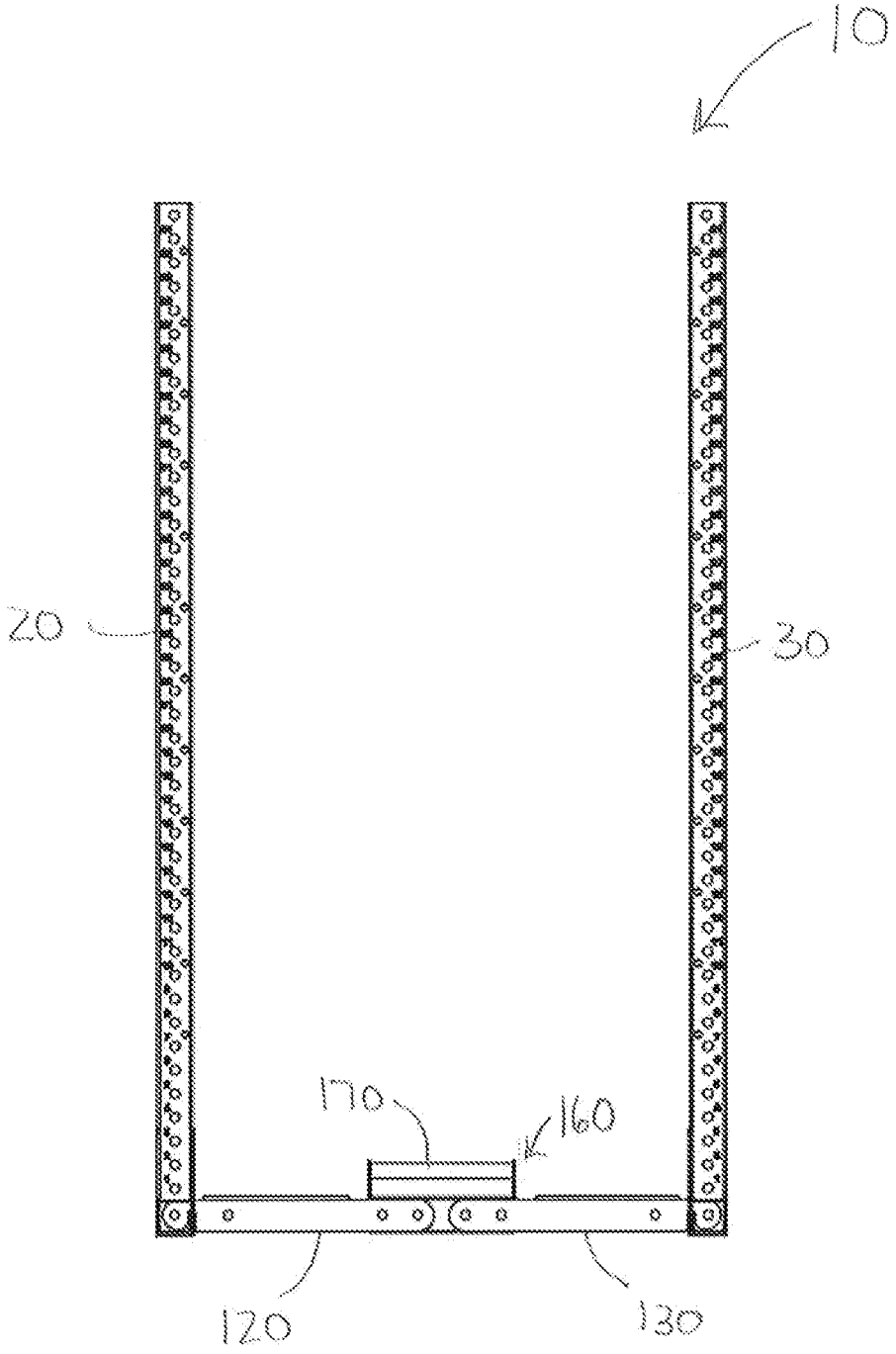
FIG. 3 is a front view of the foldable and movable squat rack in the open configuration forming one aspect of this disclosure.
Figure 4:
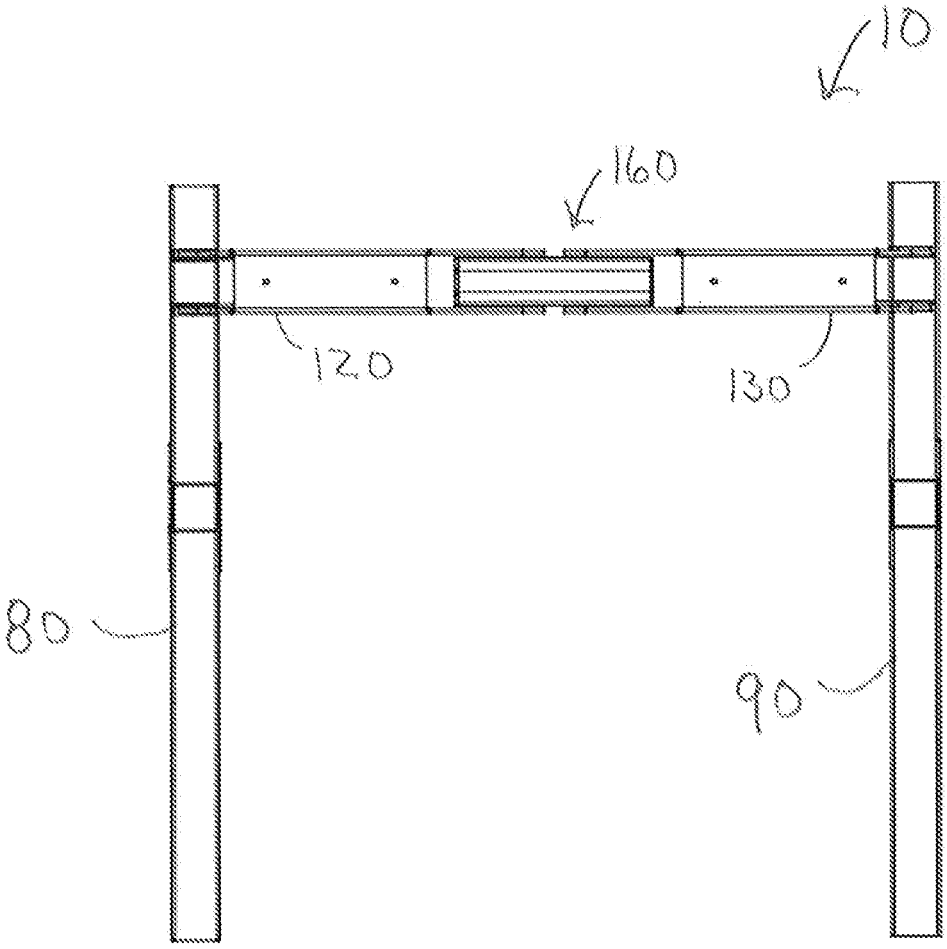
FIG. 4 is a top view of the foldable and movable squat rack in the open configuration forming one aspect of this disclosure.

In the following detailed description, reference is made to the accompanying drawings and photographs that form a part hereof, and in which is shown by way of illustration, specific embodiments in which the invention may be practiced. These embodiments are described in sufficient detail to enable those skilled in the art to practice the embodiments and like numerals represent like details in the various figures. Also, it is to be understood that other embodiments may be utilized and that process or other changes may be made without departing from the scope of the disclosure. The following detailed description is not to be taken in a limiting sense, and the scope of the invention is defined only by the appended claims and their equivalents. In accordance with the disclosure, a foldable fitness or weight rack for performing squats and other exercises is hereinafter described.

Reference is now made to FIGS. 1-13, which illustrate a foldable and movable squat rack 10. The squat rack 10 is typically made from a rigid material, such as steel to withstand the rigors of commercial gym use while maintaining home gym versatility. In one particular embodiment, the foldable squat rack 10 may be constructed from 3×3" 11-gauge tube steel and ¼" formed flat steel. The thickness of the steel provides sufficient structural integrity such that the squat rack 10 has a weight capacity of at least 1000 pounds and is appropriate for extended use.

The foldable squat rack 10 includes at least two uprights or upstanding posts 20, 30 connected to a base 40 via a plurality of upright gusset plates 50. The uprights 20, 30 are spaced apart, parallel to one another and extend upward from the base 40. The uprights 20, 30 may extend various heights from the base or ground, such as 75", 87" and 99". Each of the uprights 20, 30 have a plurality of first holes 60 extending the front and rear faces such that pins may be used to fasten certain attachments, such as spotter arms, J-hooks 170, 180 and dip bars. The plurality of first holes 60 may be numbered so that J-hooks and other attachments may easily be connected to each upright in the proper position. In addition, each of the uprights 20, 30 have a plurality of second holes 70 extending through the side faces such that additional pins may be used to fasten certain attachments, such as a removable pull-up bar.

The base 40 of the foldable squat rack 10 includes two feet or arms 80, 90 positioned on the floor of the workout space. The feet 80, 90 are spaced apart, parallel to one another and extend horizontally in a direction perpendicular to the respective uprights 20, 30, i.e., foot 80 extends perpendicular to upright 20, while foot 90 extends perpendicular to upright 30. In the embodiment shown in FIGS. 1-13, the feet are approximately 48" in length and are spaced apart by 49". Each of the feet 80, 90 have a first set of apertures (not shown because bolts 340 are positioned within the apertures) extending through each of the side faces such that bolts may be inserted for securing the uprights 20, 30 via the gusset plates 50. In the embodiment shown, the uprights are positioned substantially in the center of the feet 80, 90. At least one of the feet 80, 90 may also have a second set of apertures 100 in each of the side faces such that pins may be inserted for securing one or more removable wheels for moving the rack in a closed or storage position. In the embodiment illustrated in FIG. 13, one or more removable wheels is part of a wheel kit 110.

The feet 80, 90 are connected together by a foldable cross-member. In the embodiment shown in FIGS. 1-13, the foldable cross-member includes a first folding bracket 120 connecting to the first foot 80 and a second folding bracket 130 connecting to the second foot 90. Each of the folding brackets 120, 130 have opposed spaced ends or spacers 290, 300. The folding brackets 120, 130 connect to the respective feet 80, 90 by sliding the spaced ends 290 over a projection 140 in each of the feet and into a pair of grooves 150 in each of the feet 80, 90. A pin 350 or other fastener may be used to secure the folding brackets 120, 130 to the respective feet 80, 90, wherein the spaced ends overlap with the projection 140.

The folding brackets 120, 130 are connected together by a handle bracket 160. The handle bracket 160 includes a handle 170 connecting one side of the handle bracket to an opposite side. The handle 170 (which may be a round tube or any other suitable shape) is spaced from the handle bracket 160 such that an operator may easily grasp the handle in order to move the rack 10 from a working or open position to a storage or closed position.

As discussed above, one of the uprights 20 is connected to the first foot 80, while the other upright 30 is connected to the second foot 90. As shown in FIG. 1, each upright 20, 30 is connected to the base 40 with two upright gusset plates 50, which provide support to the uprights. One of the gusset pieces attaches to a first side of the upright post and a first side of the foot, while the other of the gusset pieces attaches to the opposite side of upright post and a second side of the foot via bolts or other fasteners.

The removable wheel kit 110 includes one or more removable caster wheels 200 that attaches to one of the feet 80, 90. One caster wheel may attach near one end of the foot by inserting it through one of the plurality of holes, while another caster wheel may attach near an opposite end of the foot by inserting it through one of the plurality of holes. After the foldable squat rack 10 is folded into a storage position (as discussed in detail below), an individual may tilt the squat rack toward the wheels and easily move the squat rack into a desired position, such as a storage location or a work out location. For example, an individual may store the squat rack in a garage for use. However, on a particular nice temperature day, an individual could move the squat rack into the driveway for use in the sun.

As shown in FIGS. 1-4, the foldable squat rack 10 is shown in its extended, working or open position. When the workout is completed, an individual may easily fold the squat rack 10 horizontally into a closed or storage position (perhaps best illustrated in FIGS. 5-12). Preferably, all attachments, such as the J-hooks and spotter arms should be removed from the squat rack 10 prior to collapsing. Once the attachments have been removed, the pins in the folding brackets 120, 130 and handle bracket 160 should be removed. In the illustrated embodiment, four pins are removed, one for each folding bracket and two for the handle.

Subsequently, the individual may pull up on the handle 170 vertically away from the floor. The handle 170 is able to extend vertically because the spaced ends 290, 300 of the folding brackets 120, 130 are able to move within the grooves 150 in each of the feet 80, 90. Specifically, the handle bracket 160 fits within the free end (i.e., the end of the folding brackets 120, 130 not connected to the feet 80, 90) of each of the spaced ends 290, 300 of the folding brackets and then is secured to the folding brackets by a plurality of fasteners, including pins and/or bolts. As the handle is pulled upward, the individual may move (i.e., push or pull) one of the upright posts 30 towards the other upright post 20 to collapse/fold the squat rack 10 horizontally. Once the squat rack 10 is in the folded/stored condition, the pins may be re-inserted (so they are not misplaced) to further secure and/or lock the rack in the storage position. Then, the squat rack 10 may be tiled and rolled via the wheel kit 110 into a preferred storage location.

Advantageously, the squat rack 10 is designed to withstand the rigors of commercial gym use while maintaining home gym versatility. Specifically, the squat rack 10 can be transformed from its working footprint, i.e., 49"×48" to a locked, stored footprint, i.e., 12"×48" in less than a minute. Furthermore, the wheel kit allows the squat rack to be easily moved to any desired storage or workout location.

Turning to FIGS. 14-24, a power rack 210 is illustrated. The power rack 210 is substantially similar to the squat rack 10 in terms of materials used and has a weight capacity of over 1,000 pounds. The main difference is the power rack includes two additional uprights 220, 230. In other words, the power rack includes a first pair of uprights 20', 220, each of the first pair of uprights connected to a base 40' via a plurality of gusset plates 50' and a second pair of uprights 30', 230, each of the second pair of uprights connected to a base 40' via a plurality of gusset plates 50'. The first pair of uprights are spaced apart, parallel to one another and parallel to the second pair of uprights.

The base 40' of the foldable power rack 210 includes two feet or arms 80,' 90' positioned on the floor. The feet 80', 90' are spaced apart, parallel to one another and extend horizontally in a direction perpendicular to the respective pair of uprights 220, 230, i.e., foot 80' extends perpendicular to the first pair of uprights 20', 220, while foot 90' extends perpendicular to the second pair of uprights 30', 230. In the embodiment shown in FIG. 14, each of the front uprights are separated from the rear uprights by 24' such that the usable depth is 24'. The feet 80', 90' are approximately 48" in length and are spaced apart by 49". Each of the feet 80', 90' have a plurality of holes extending through each of the side faces such that bolts may be inserted for securing each of the pair of uprights via the gusset plates 50'. Each of the front uprights are secured to the respective foot near the front edge of the foot, while the rear uprights are connected to the respective foot adjacent to the foldable cross-member.

Each of the pair of uprights are connected to one another in multiple locations. In addition to being connected by the respective feet, a second connection may exist via a rigid rod and pipe system 250 (shown in FIG. 25) or a flexible safety strap system (not shown). Each of these systems is easily removable via pins from the uprights. A third connection for the uprights exists near the top of the respective uprights via a slotted cross-member bar 260 that is connected via a weld to both the front and rear upright on each side of the rack. The power rack 210 may also include an adjustable bar or multi-grip bar 270 for pull-up exercises and the like.

As shown in FIGS. 21-24, the power rack 210 is easily foldable in the same manner as the squat rack 10. Indeed, similar to the squat rack 10, the feet 80', 90' are connected together by a foldable cross-member. The foldable cross-member includes a first folding bracket 120' connecting to the first foot 80', while a second folding bracket 130' connects to the second foot 90'. The folding brackets 120', 130' are connected together by a handle bracket 160'. The handle bracket 160' includes a handle 170' connecting one side of the handle bracket to an opposite side. To fold the power rack into a storage position, an individual should remove all attachments and the pins for the foldable cross-member and then pull up on the handle 170' while pulling on one of the pair of upright posts towards the other pair of upright posts to collapse/fold the power rack 210 horizontally. Once the power rack 210 is in the folded/stored condition, the pins may be re-inserted (so they are not misplaced) to further secure the rack. Then, the power rack 210 may be rolled via one or more wheel kits into a preferred storage location.

Figure 5:
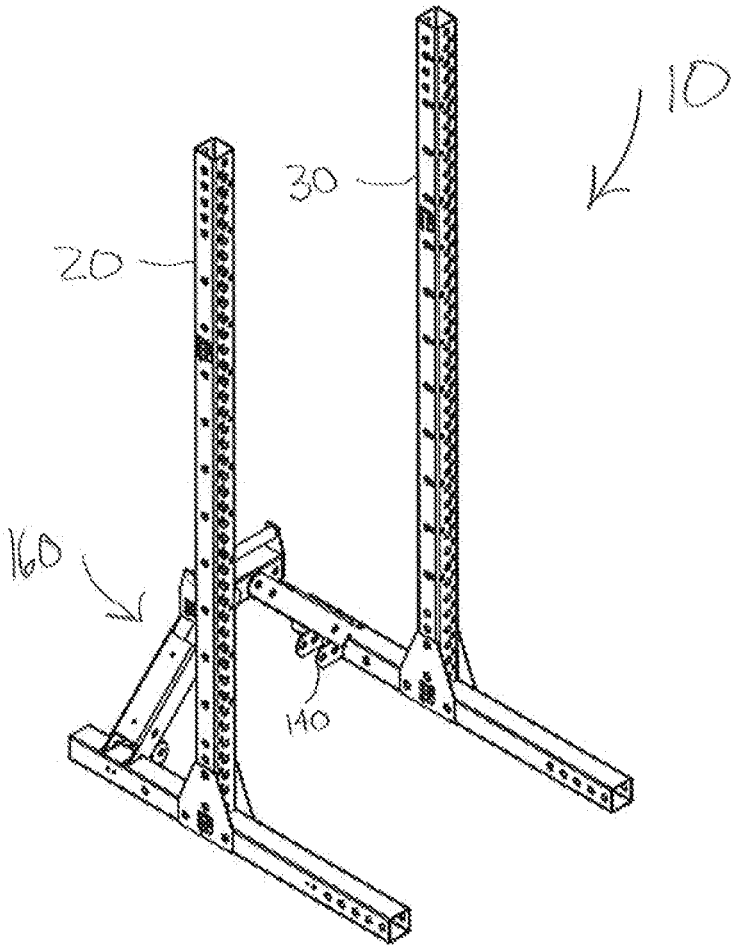
FIG. 5 is a front perspective view of a foldable and movable squat rack in a partially closed configuration forming one aspect of this disclosure.
Figure 6:
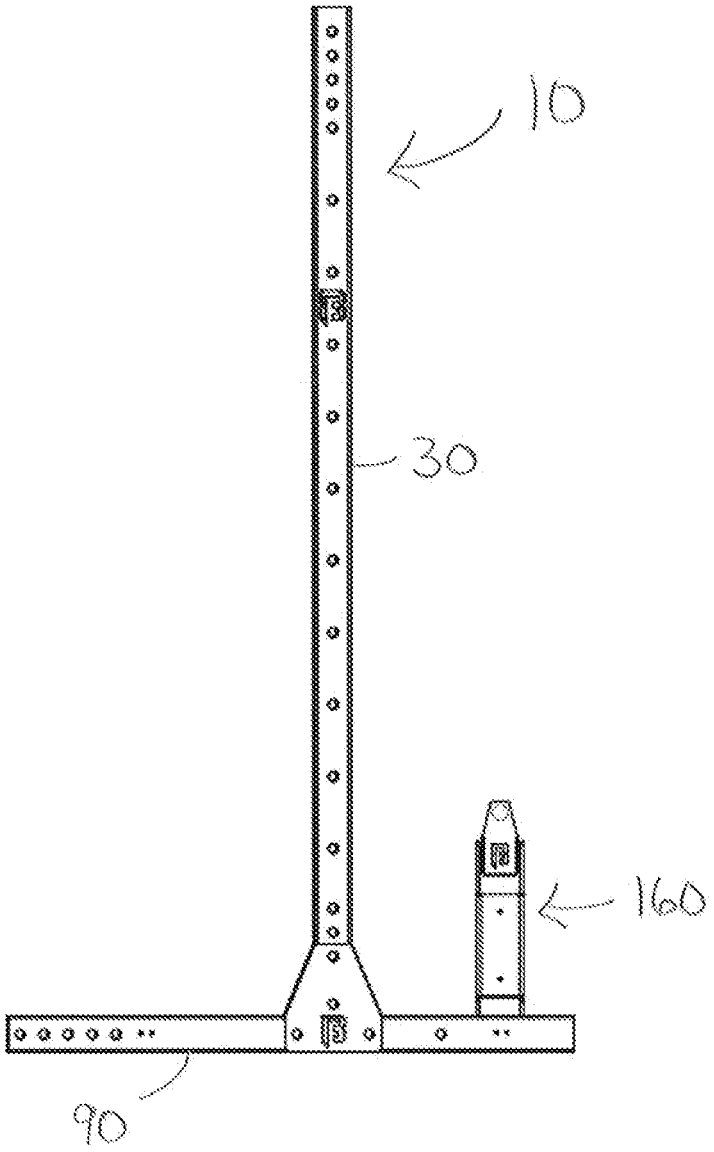
FIG. 6 is a side view of the foldable and movable squat rack in the partially closed configuration forming one aspect of this disclosure.
Figure 7:
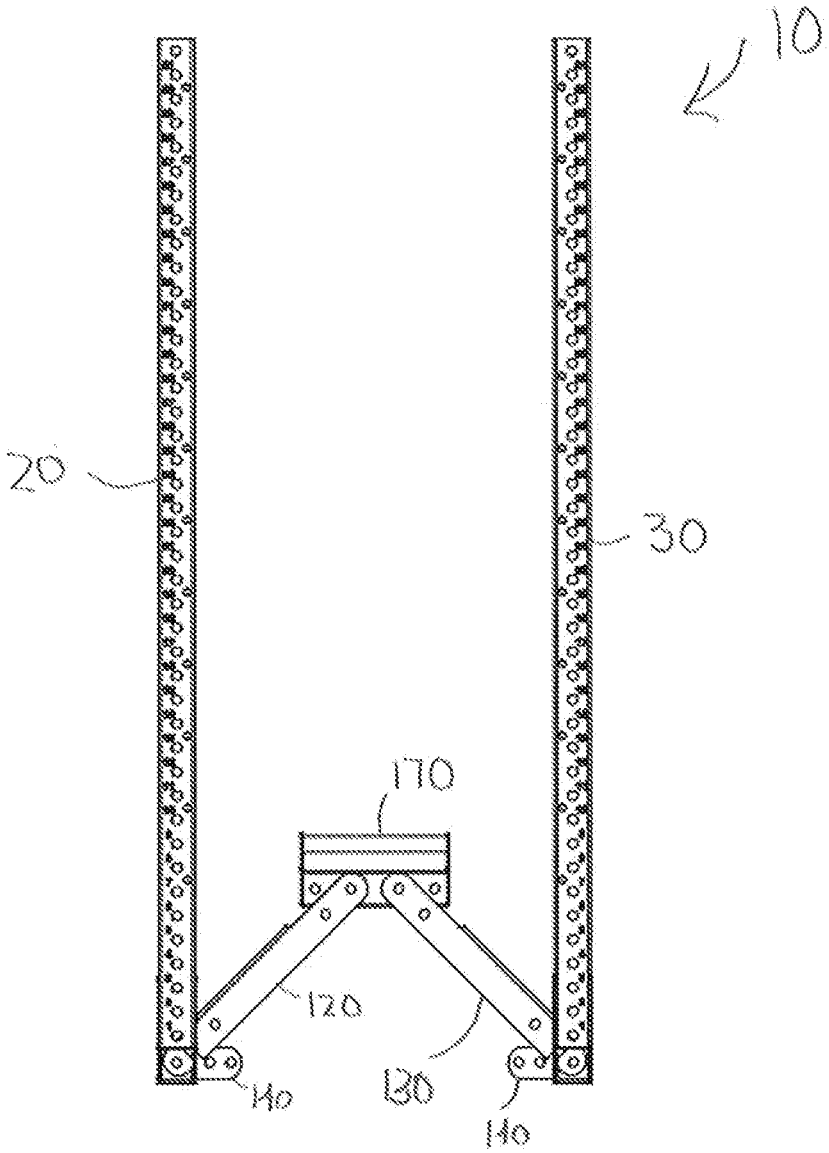
FIG. 7 is a front view of the foldable and movable squat rack in the partially closed configuration forming one aspect of this disclosure.
Figure 8:
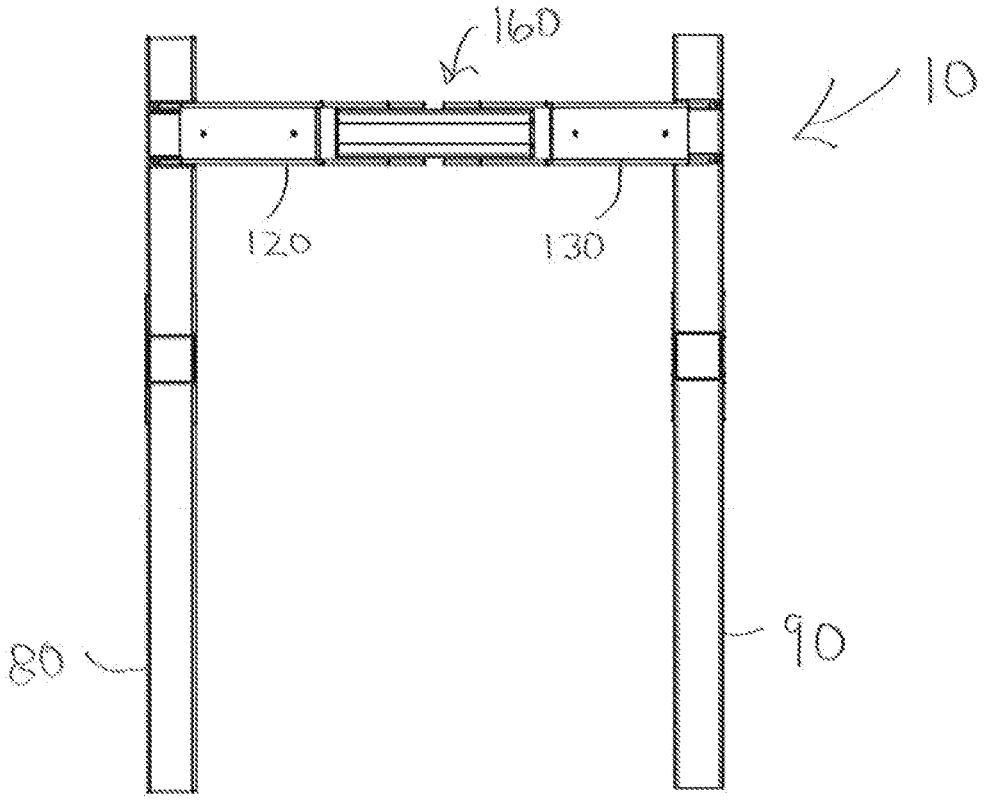
FIG. 8 is a top view of the foldable and movable squat rack in the partially closed configuration forming one aspect of this disclosure.
Figure 9:
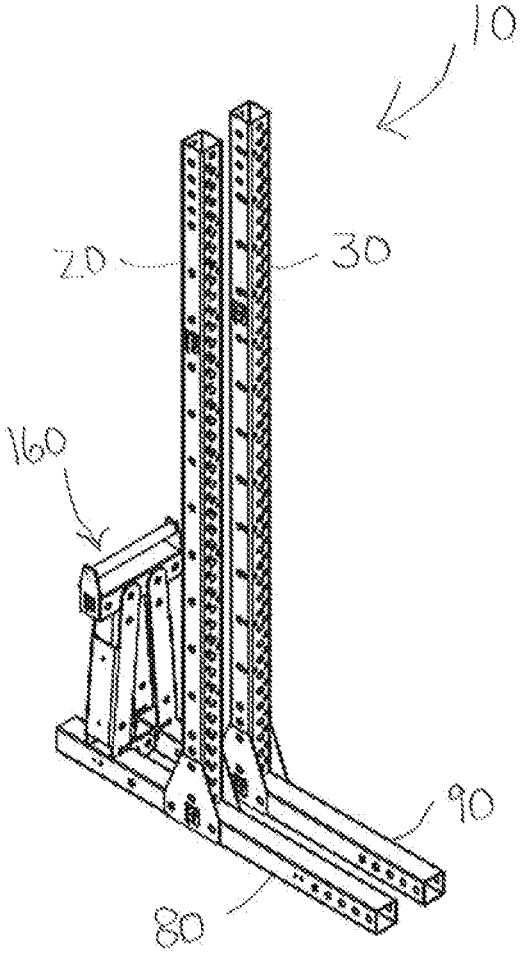
FIG. 9 is a front perspective view of a foldable and movable squat rack in a fully closed configuration forming one aspect of this disclosure.
Figure 10:
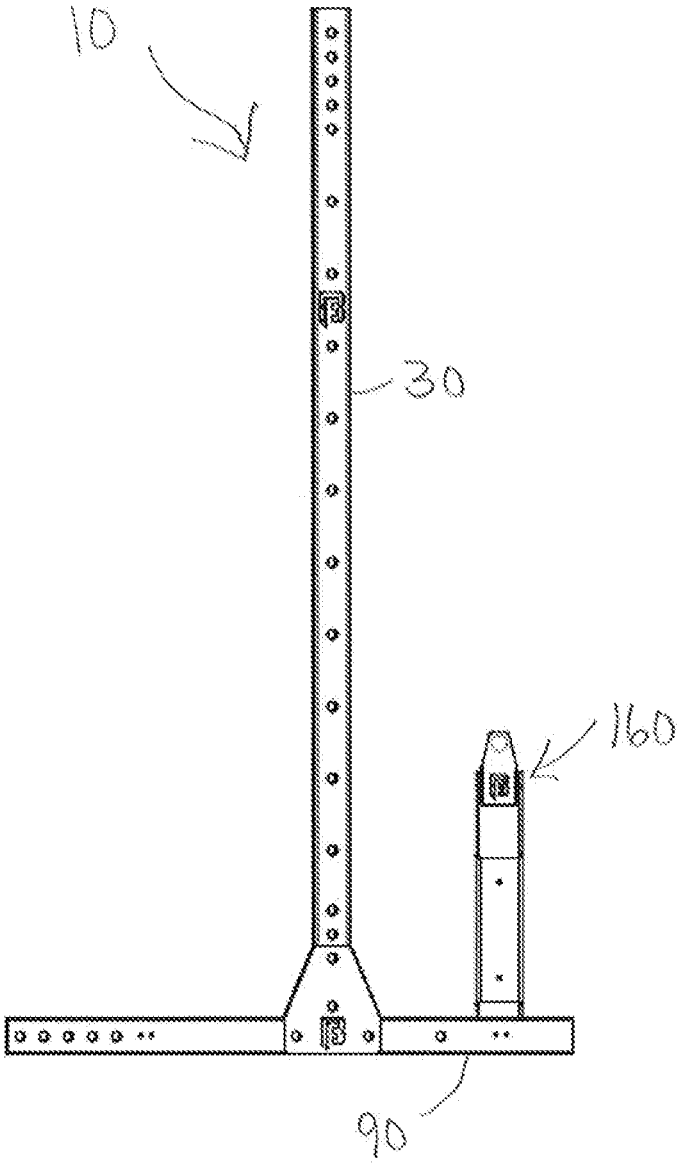
FIG. 10 is a side view of the foldable and movable squat rack in the fully closed configuration forming one aspect of this disclosure.
Figure 11:
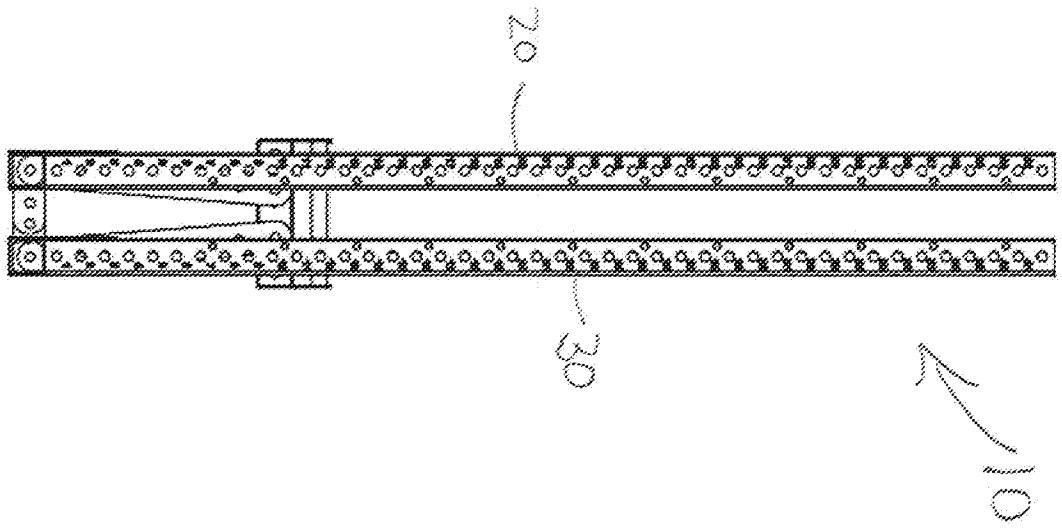
FIG. 11 is a front view of the foldable and movable squat rack in the fully closed configuration forming one aspect of this disclosure.
Figure 12:
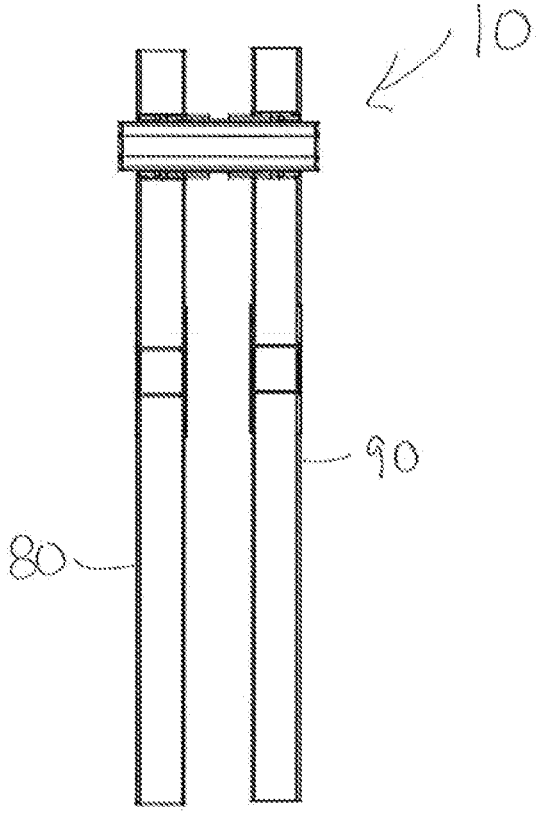
FIG. 12 is a top view of the foldable and movable squat rack in the fully closed configuration forming one aspect of this disclosure.
Figure 13:
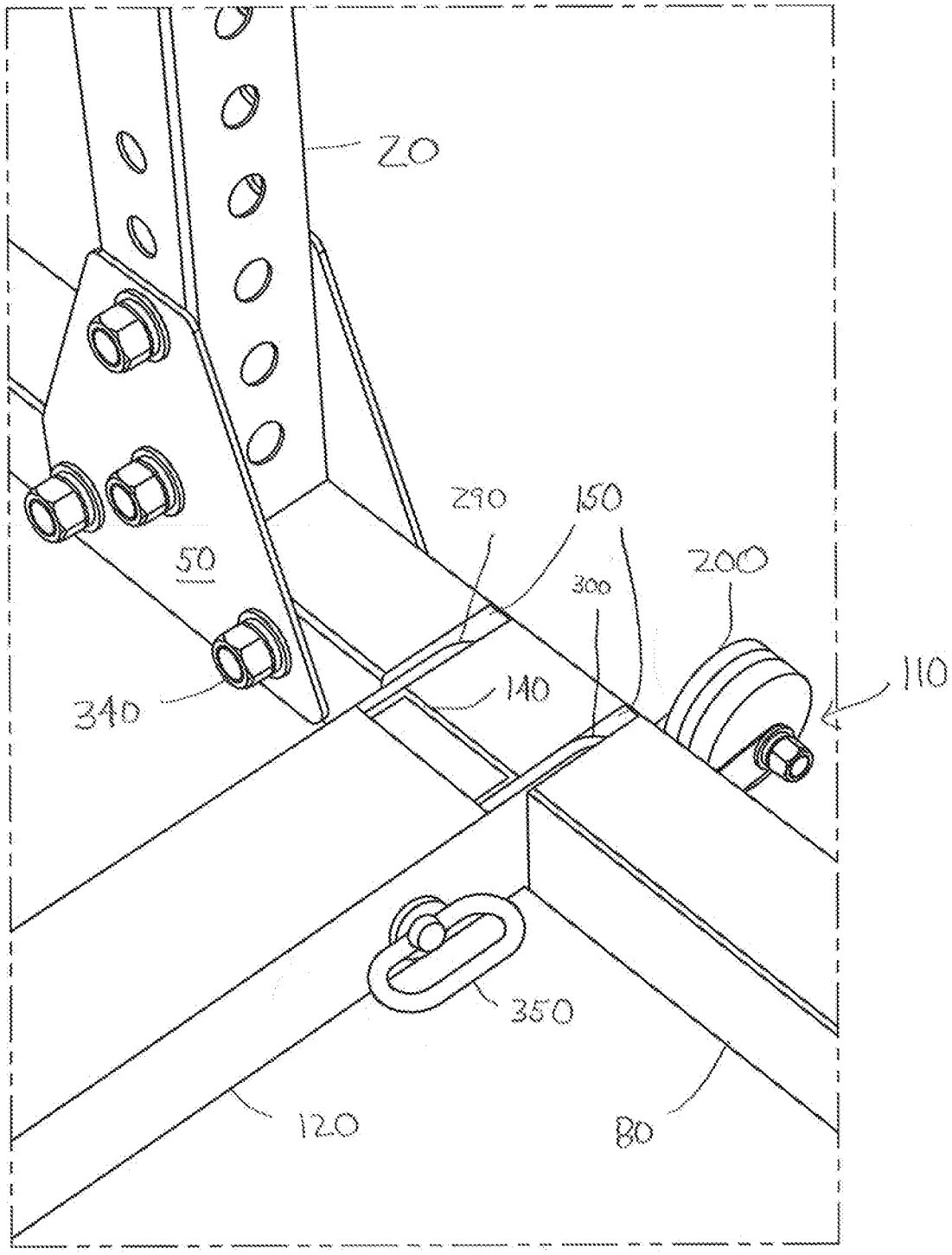
FIG. 13 is a partial top view of the base of the foldable and movable squat rack forming one aspect of this disclosure.
Figure 14:
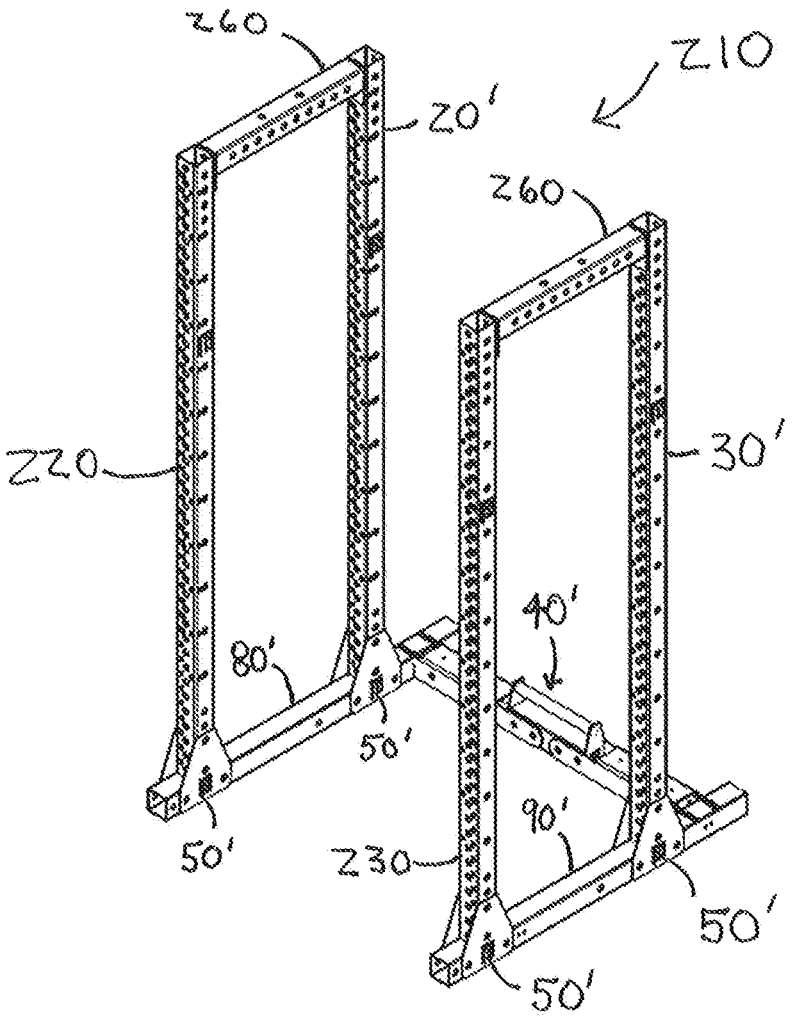
FIG. 14 is a front perspective view of a foldable and movable power rack in an open configuration forming one aspect of this disclosure.
Figure 15:
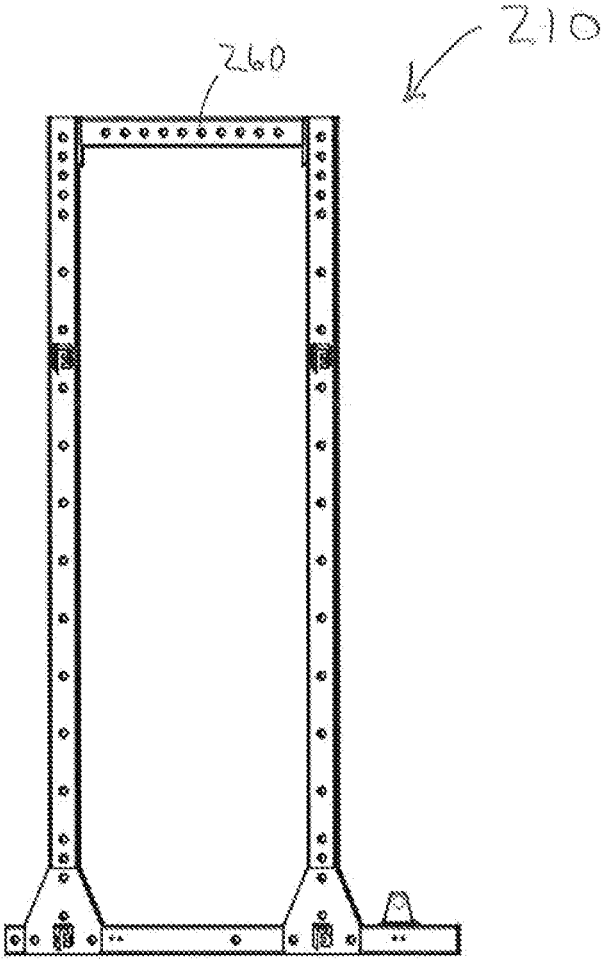
FIG. 15 is a side view of the foldable and movable power rack in the open configuration forming one aspect of this disclosure.
Figure 16:
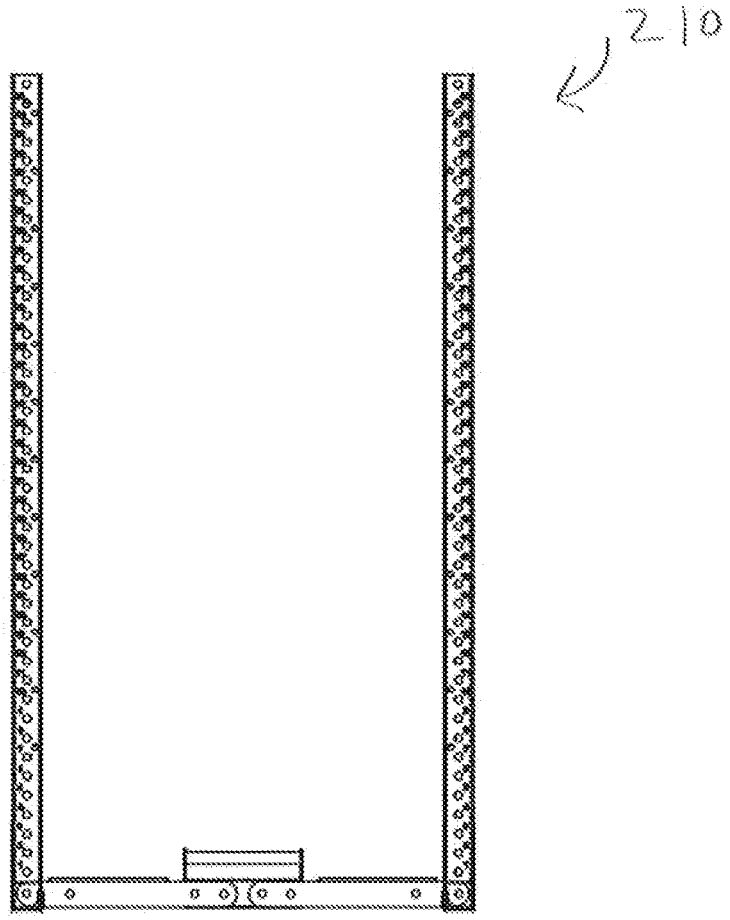
FIG. 16 is a front view of the foldable and movable power rack in the open configuration forming one aspect of this disclosure.
Figure 17:
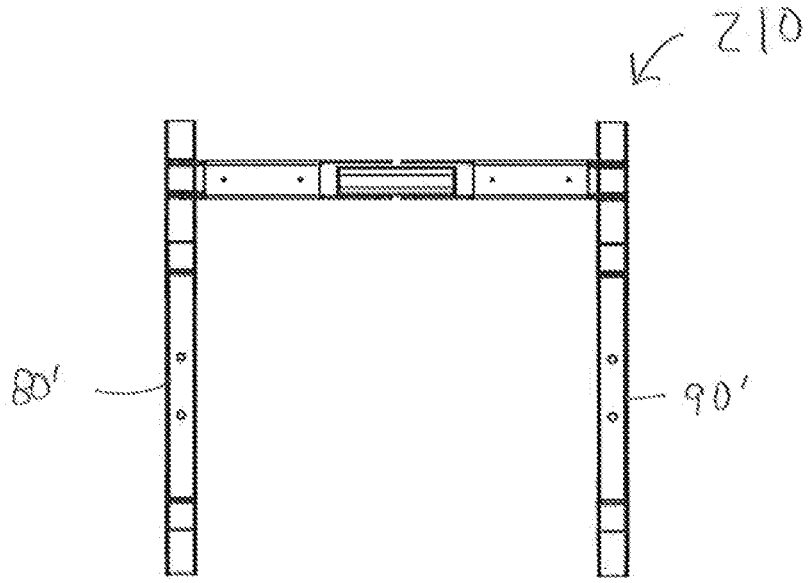
FIG. 17 is a top view of the foldable and movable power rack in the open configuration forming one aspect of this disclosure.
Figure 18:
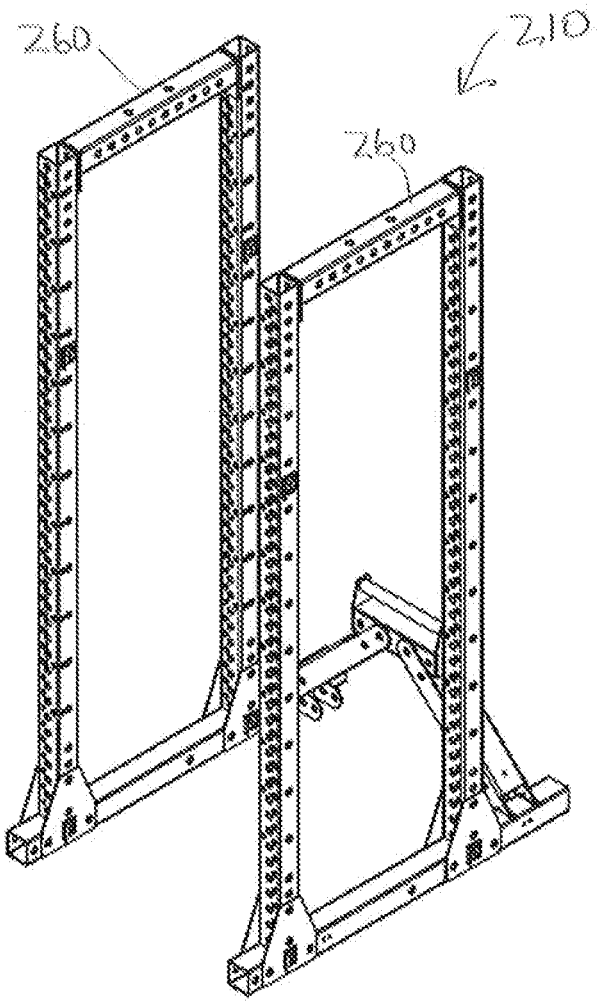
FIG. 18 is a front perspective view of the foldable and movable power rack in a partially closed configuration forming one aspect of this disclosure.
Figure 19:
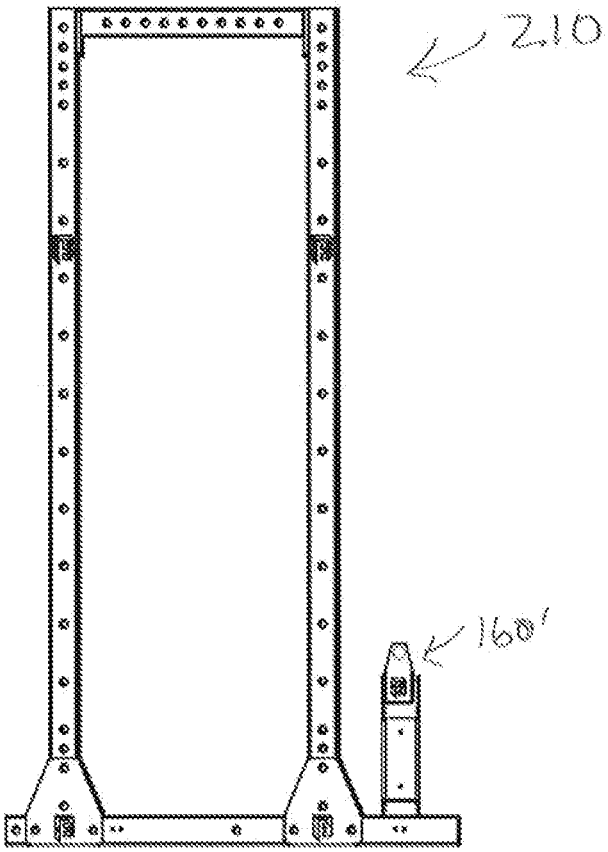
FIG. 19 is a side view of the foldable and movable power rack in the partially closed configuration forming one aspect of this disclosure.
Figure 20:
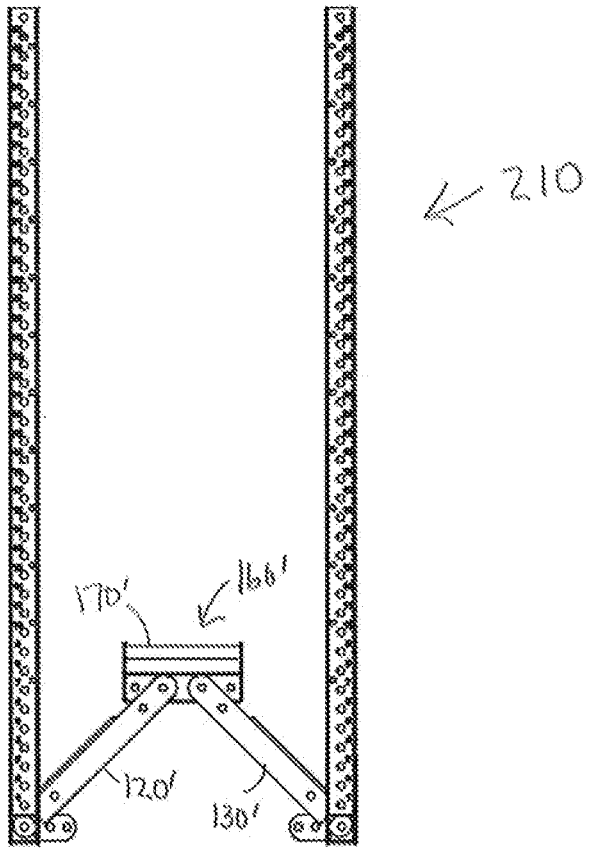
FIG. 20 is a front view of the foldable and movable power rack in the partially closed configuration forming one aspect of this disclosure.
Figure 21:
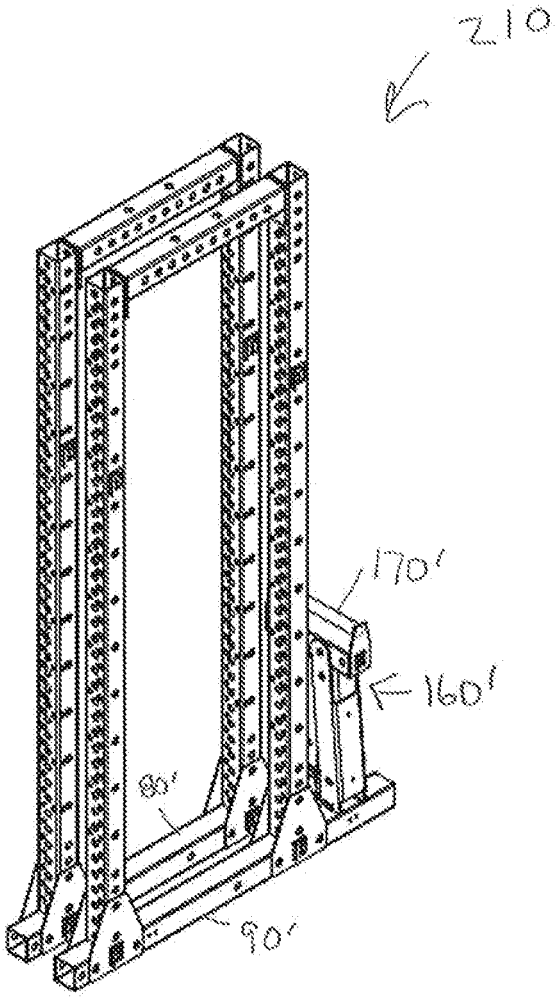
FIG. 21 is a front perspective view of the foldable and movable power rack in a fully closed configuration forming one aspect of this disclosure.
Figure 22:
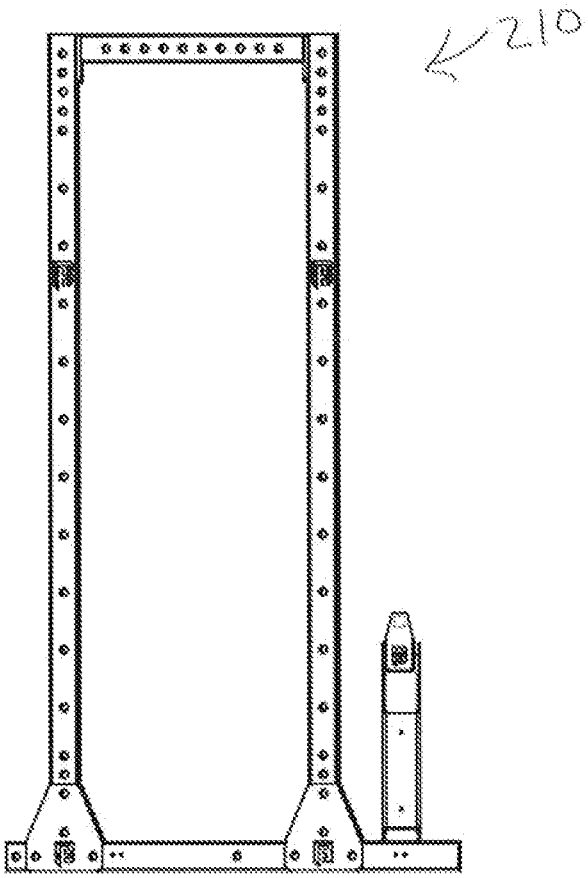
FIG. 22 is a side view of the foldable and movable power rack in the fully closed configuration forming one aspect of this disclosure.
Figure 23:
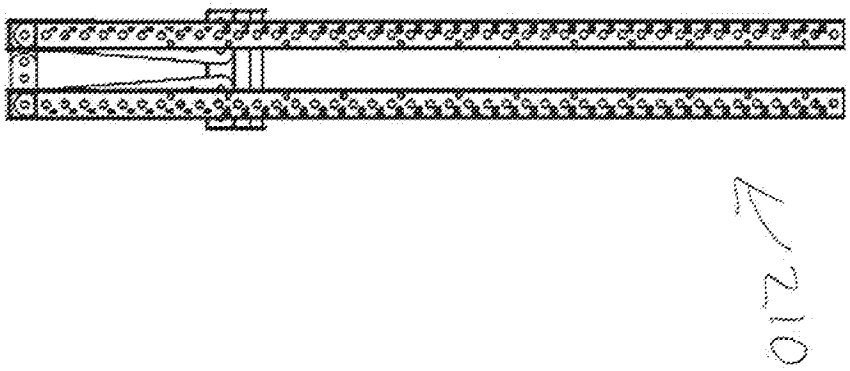
FIG. 23 is a front view of the foldable and movable power rack in the fully closed configuration forming one aspect of this disclosure.
Figure 24:
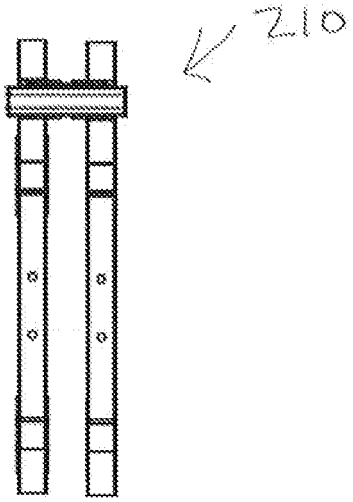
FIG. 24 is a top view of the foldable and movable power rack in the fully closed configuration forming one aspect of this disclosure.
Figure 25:
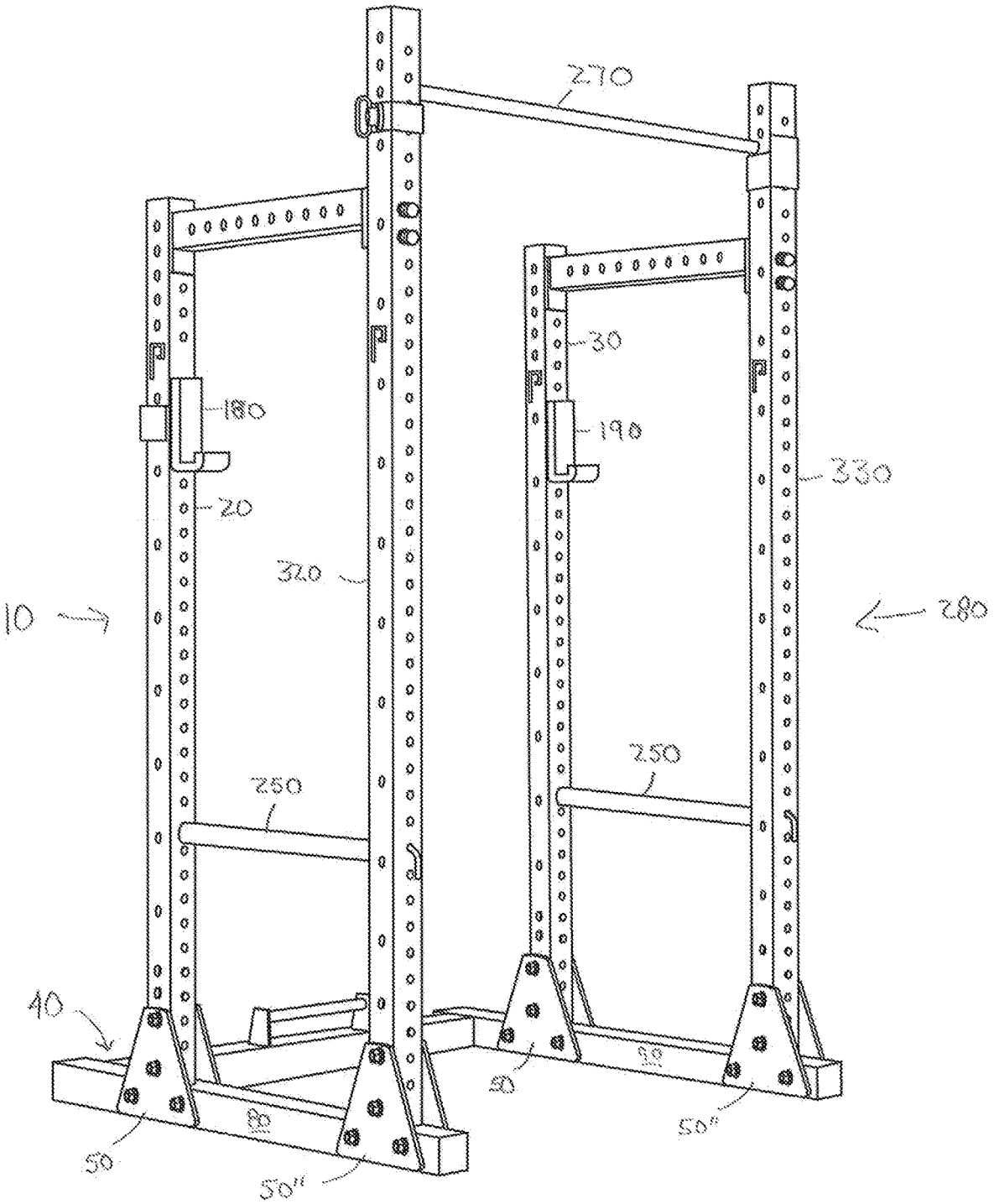
FIG. 25 is a top perspective view of an expansion kit connected to a movable and foldable squat rack forming one aspect of this disclosure.

Turning to FIG. 25, an expansion kit 280 is disclosed that may be used to transform an existing squat rack (such as the one shown in FIG. 1) into a power rack (as shown in FIG. 5). Advantageously the existing squad rack may be transformed into a power rack in about fifteen (15) minutes. Specifically, the expansion kit 280 includes an additional pair of uprights 320, 330, a set of slotted cross-members for connecting the additional uprights 320, 330 to the existing uprights 20 and 30, an extra set of gusset plates 50" for connecting the additional uprights to the respective feet 80 and 90 of the squat rack, a safety system for connecting the uprights on each side to each other and a removable pull-up bar. Advantageously, the height of the additional uprights 320, 330 may be mixed and matched with the existing uprights of the squat rack to create a customized power rack configuration. The expansion kit 280 is easily removably connected to the existing squat rack via pins and bolts.

The foregoing descriptions of various embodiments have been presented for purposes of illustration and description. These descriptions are not intended to be exhaustive or to limit the invention to the precise forms disclosed. The embodiments described provide the best illustration of the inventive principles and their practical applications to thereby enable one of ordinary skill in the art to utilize the disclosure in various embodiments and with various modifications as are suited to the particular use contemplated.

The invention claimed is:

1. A fitness rack, comprising:

a base including a first arm, a second arm, and a foldable cross-member having a handle, wherein the first arm is connected to a first end of the foldable cross-member and the second arm is connected to a second, opposed end of the foldable cross-member, and wherein the foldable cross-member includes a first bracket connected to the first arm and a second bracket connected to the second arm;

a first pair of uprights connected to the base, wherein the handle is configured to be raised to horizontally collapse the pair of uprights such that the fitness rack is transferred from an extended position to a closed position.

2. The fitness rack of claim 1, wherein the first arm is perpendicular to a first of the pair of uprights.

3. The fitness rack of claim 1, wherein the second arm is perpendicular to a second of the pair of uprights.

4. The fitness rack of claim 3, wherein each of the pair of uprights connects to a respective one of the first and second arms via one or more gussets.

5. The fitness rack of claim 1, wherein the first bracket is connected to the second bracket via the handle.

6. The fitness rack of claim 1, further including one or more wheels for connecting to the base for moving the fitness rack in the closed position.

7. The fitness rack of claim 1, further including an expansion kit having a second pair of uprights and a pair of slotted cross-members for connecting the second pair of uprights to the first pair of uprights.

8. A foldable weight rack adapted to collapse from an operating position into a storage position, comprising:

a foldable handle configured to rest substantially on a floor in the operating position;

a first arm and a second arm, each arm connected to an opposed end of the foldable handle;

a first pair of spaced upstanding posts connected to the first arm;

a second pair of spaced upstanding posts connected to the second arm, whereby the foldable handle extends upward from the floor such that the first and the second pair of spaced upstanding posts collapse together into the storage position, wherein each of the first and second pair of spaced upstanding posts have a plurality of equally spaced holes, and wherein each of the first and second arms have at least one projection for receiving a portion of a respective end of the foldable handle.

9. The foldable weight rack of claim 8, wherein one or more attachments attach to the first and second pair of spaced upstanding posts via connection to the plurality of equally spaced holes.

10. The foldable weight rack of claim 8, wherein the at least one projection in each of the first and second arms allows the portion of the respective end of the foldable handle to move freely such that the foldable handle extends upward in a vertical direction from the floor, while the first and second pair of spaced upstanding posts move only in a horizontal direction.

11. The foldable weight rack of claim 8, further including a pull-up bar connected to each of the second pair of uprights.

12. A fitness rack, comprising:

a base including a foldable cross-member having a handle, wherein the handle is a round tube; and a first pair of uprights connected to the base, wherein the handle is configured to be raised to horizontally collapse the pair of uprights such that the fitness rack is transferred from an extended position to a closed position.

13. The fitness rack of claim 12, wherein the base includes a first arm and a second arm.

14. The fitness rack of claim 13, wherein the first arm is connected to a first end of the foldable cross-member and the second arm is connected to a second, opposed end of the foldable cross-member.

15. The fitness rack of claim 13, wherein the first arm is perpendicular to a first of the pair of uprights.

16. The fitness rack of claim 13, wherein the second arm is perpendicular to a second of the pair of uprights.

17. The fitness rack of claim 16, wherein each of the pair of uprights connects to a respective one of the first and second arms via one or more gussets.

18. The fitness rack of claim 12, further including one or more wheels for connecting to the base for moving the fitness rack in the closed position.

19. The fitness rack of claim 12, further including an expansion kit having a second pair of uprights and a pair of slotted cross-members for connecting the second pair of uprights to the first pair of uprights.

* * * * *